US009416973B2

(12) United States Patent
Melton et al.

(10) Patent No.: US 9,416,973 B2
(45) Date of Patent: Aug. 16, 2016

(54) MICROMIXER ASSEMBLY FOR A TURBINE SYSTEM AND METHOD OF DISTRIBUTING AN AIR-FUEL MIXTURE TO A COMBUSTOR CHAMBER

(71) Applicant: General Electric Company, Schenectady, NY (US)

(72) Inventors: Patrick Benedict Melton, Horse Shoe, NC (US); Gregory Allen Boardman, Greer, SC (US)

(73) Assignee: General Electric Company, Schenectady, NY (US)

( * ) Notice: Subject to any disclaimer, the term of this patent is extended or adjusted under 35 U.S.C. 154(b) by 795 days.

(21) Appl. No.: 13/735,448

(22) Filed: Jan. 7, 2013

(65) Prior Publication Data

US 2014/0190174 A1 Jul. 10, 2014

(51) Int. Cl.
*F23R 3/28* (2006.01)
*F23R 3/46* (2006.01)

(52) U.S. Cl.
CPC . *F23R 3/286* (2013.01); *F23R 3/46* (2013.01); *F23R 2900/00018* (2013.01)

(58) Field of Classification Search
CPC ..... F23R 3/286; F23R 3/283; F23R 3/10; F23R 3/46; F23D 14/62
See application file for complete search history.

(56) References Cited

U.S. PATENT DOCUMENTS

| | | | | |
|---|---|---|---|---|
| 2,565,843 | A * | 8/1951 | Dennison | F23R 3/42 432/223 |
| 5,307,634 | A | 5/1994 | Hu | |
| 5,762,490 | A | 6/1998 | Rodgers | |
| 8,147,121 | B2 | 4/2012 | Lacy et al. | |
| 2007/0151255 | A1 * | 7/2007 | Johnson | F23D 14/48 60/776 |

FOREIGN PATENT DOCUMENTS

JP 2005233574 A * 9/2005

* cited by examiner

*Primary Examiner* — Phutthiwat Wongwian
*Assistant Examiner* — Stefan Ibroni
(74) *Attorney, Agent, or Firm* — Ernest G. Cusick; Frank A. Landgraff

(57) ABSTRACT

A micromixer assembly for a turbine system includes a plurality of pipes each having an inlet for receiving an airflow from an annulus defined by an inwardly disposed liner and an outwardly disposed sleeve, each of the plurality of pipes also including an outlet for dispersing an air-fuel mixture into a combustor chamber. Also included is a first portion of each of the plurality of pipes. Further included is a second portion of each of the plurality of pipes, the second portion comprising the inlet for receiving the airflow. Yet further included is at least one fuel receiving path in communication with at least one of the first portion and the second portion.

8 Claims, 9 Drawing Sheets

MICROMIXER ASSEMBLY FOR A TURBINE SYSTEM AND METHOD OF DISTRIBUTING AN AIR-FUEL MIXTURE TO A COMBUSTOR CHAMBER

BACKGROUND OF THE INVENTION

The subject matter disclosed herein relates to turbine systems, and more particularly to a micromixer assembly of a gas turbine engine, as well as a method of distributing an air-fuel mixture to a combustor chamber of the gas turbine engine.

Gas turbine systems may include a micromixer, where air distribution to an individual air-fuel pipe should remain at a mean average value of the overall flow. The micromixer typically includes a plurality of pipes or tubes, each having an inlet. Due to upstream conditions, such as the flow experiencing a sharp turn just prior to entering the inlets, non-uniform mass flow often prevails, thereby hindering engine performance. Decreased performance is a result of ineffective air-fuel mixing prior to injection to the combustor chamber, thereby increasing NOx emissions, for example.

BRIEF DESCRIPTION OF THE INVENTION

According to one aspect of the invention, a micromixer assembly for a turbine system includes a plurality of pipes each having an inlet for receiving an airflow from an annulus defined by an inwardly disposed liner and an outwardly disposed sleeve, each of the plurality of pipes also including an outlet for dispersing an air-fuel mixture into a combustor chamber. Also included is a first portion of each of the plurality of pipes. Further included is a second portion of each of the plurality of pipes, the second portion comprising the inlet for receiving the airflow. Yet further included is at least one fuel receiving path in communication with at least one of the first portion and the second portion.

According to another aspect of the invention, a micromixer assembly for a turbine system includes a plurality of pipes each having an inlet for receiving an air-fuel mixture from an annulus defined by an inwardly disposed liner and an outwardly disposed sleeve, each of the plurality of pipes also including an outlet for dispersing the air-fuel mixture into a combustor chamber. Also included is a first portion of each of the plurality of pipes, the first portion comprising a relatively linear region and the outlet. Further included is a second portion of each of the plurality of pipes, the second portion comprising the inlet for receiving the air-fuel mixture and a curved region for redirecting the air-fuel mixture toward the first portion.

According to yet another aspect of the invention, a method of distributing an air-fuel mixture to a combustor chamber is provided. The method includes routing an airflow from an annulus defined by an inwardly disposed liner and an outwardly disposed sleeve to a curved region of a pipe. Also included is redirecting an air-fuel mixture to a relatively linear region of the pipe. Further included is dispersing the air-fuel mixture into the combustor chamber through an outlet of the pipe.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
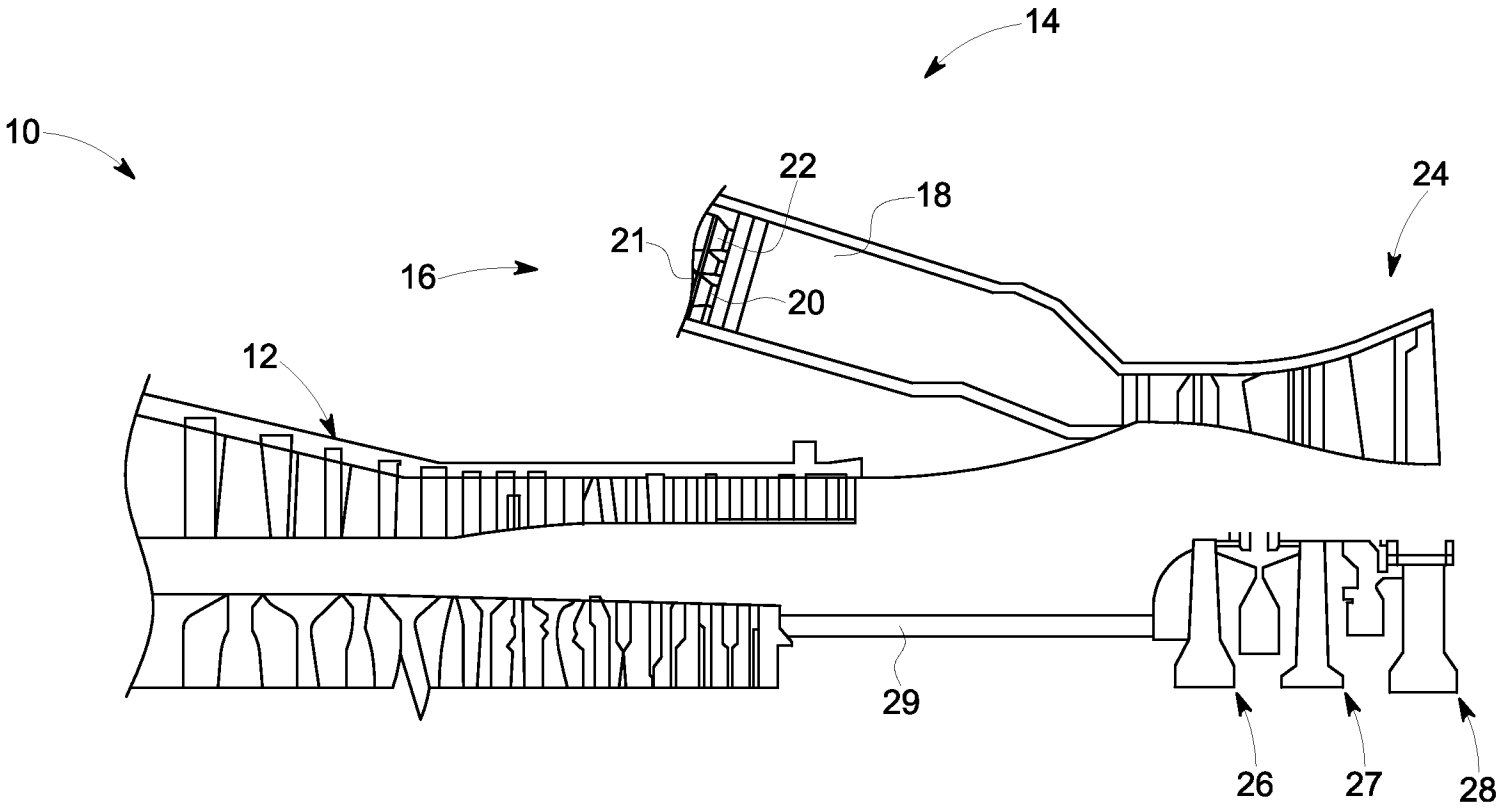
FIG. 1 is a schematic illustration of a gas turbine engine.

Referring to FIG. 1, a gas turbine engine 10 constructed in accordance with an exemplary embodiment of the present invention is schematically illustrated. The gas turbine engine 10 includes a compressor 12 and a plurality of combustor assemblies arranged in a can annular array, one of which is indicated at 14. As shown, the combustor assembly 14 includes an endcover assembly 16 that seals, and at least partially defines, a combustor chamber 18. A plurality of tube bundles 20-22 are supported by the endcover assembly 16 and supply fuel to an interior region of the combustor assembly 14. The tube bundles 20-22 receive fuel through a common fuel inlet (not shown) and compressed air from the compressor 12. The fuel and compressed air are passed into the combustor chamber 18 and ignited to form a high temperature, high pressure combustion product or airstream that is used to drive a turbine 24. The turbine 24 includes a plurality of stages 26-28 that are operationally connected to the compressor 12 through a compressor/turbine shaft 29 (also referred to as a rotor).

In operation, air flows into the compressor 12 and is compressed into a high pressure gas. The high pressure gas is supplied to the combustor assembly 14 and mixed with fuel, for example natural gas, fuel oil, process gas and/or synthetic gas (syngas), in the combustor chamber 18. The fuel/air or combustible mixture ignites to form a high pressure, high temperature combustion gas stream. In any event, the combustor assembly 14 channels the combustion gas stream to the turbine 24 which converts thermal energy to mechanical, rotational energy.

Figure 2:
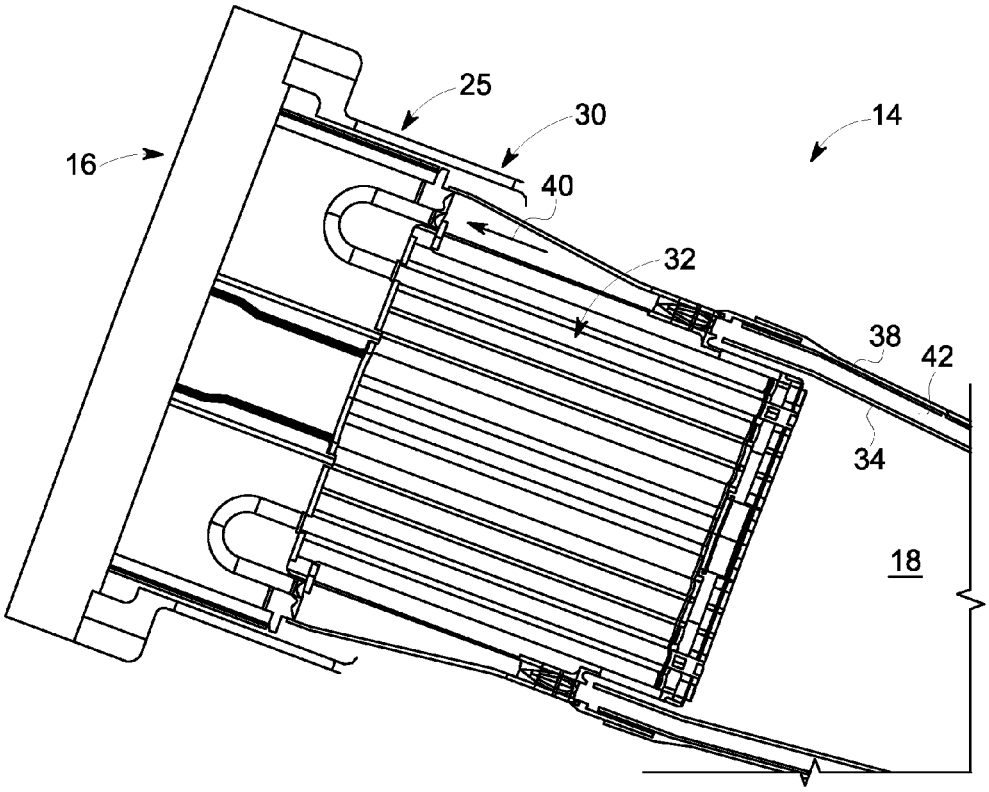
FIG. 2 is a partial sectional view of a combustor assembly of the gas turbine engine, the combustor assembly having a micromixer assembly.
Figure 4:
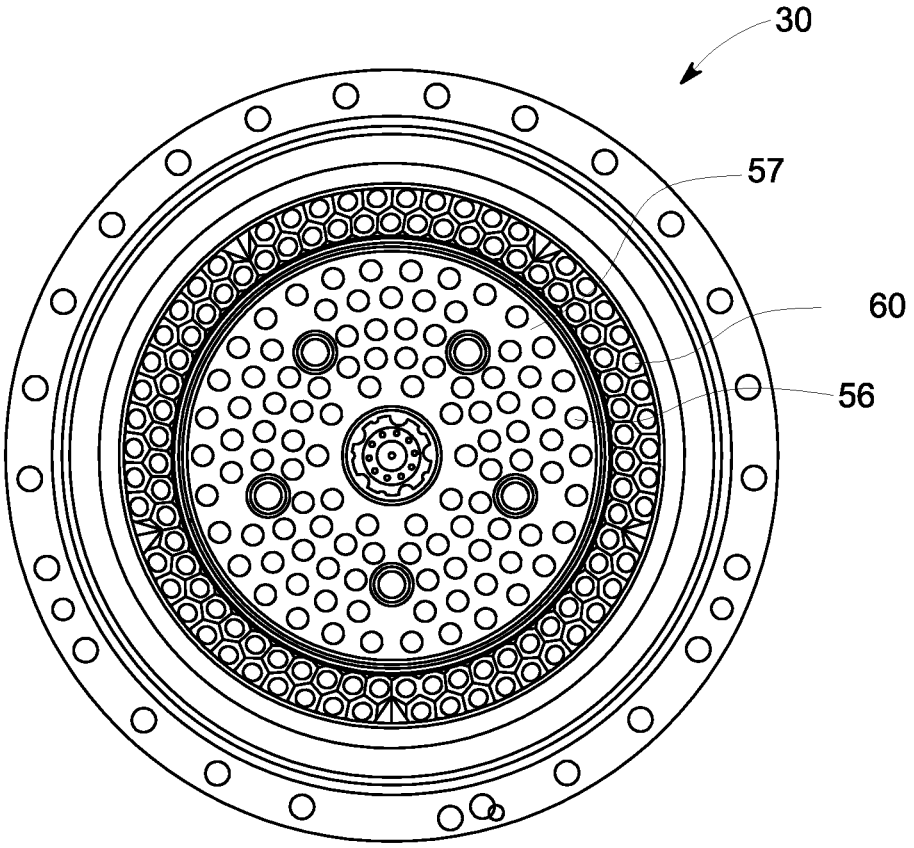
FIG. 4 is an elevational end view of the micromixer assembly according to the first embodiment of FIG. 3.

Referring now to FIG. 2, as noted above, a can annular array of combustor assemblies is arranged in a circumferentially spaced manner about an axial centerline of the gas turbine engine 10. For illustration clarity, a partial view of a single combustor assembly of the can annular array is shown and includes the combustor chamber 18 and a head end 25. The head end 25 is disposed at an adjacent upstream location of the combustor chamber 18 and includes a micromixer assembly 30. The micromixer assembly 30 includes a plurality of pipes 32 that may be appropriated into sectors. In an exemplary embodiment, as shown in FIG. 4, the micromixer assembly 30 includes five sectors, with each sector having about 21 pipes. However, it is to be understood that the actual number of sectors and number of pipes within each sector may vary depending on the application of use. Each of the plurality of pipes 32 may vary in dimension. In one embodiment, each pipe comprises an outer diameter of about 0.875" (about 22.2 mm) and a tube thickness of about 0.049" (about 1.24 mm). Although referred to throughout the specification as the plurality of pipes 32, it is to be understood that a plurality of passages are employed for a cast assembly. Therefore, for clarity of description, the term pipes is referenced herein, but the term is to be understood to be used synonymously with passages.

The combustor chamber 18 is defined by a liner 34, such as an inwardly disposed liner. Spaced radially outwardly of the liner 34, and surroundingly enclosing the liner 34, is a sleeve 38, such as a flow sleeve, for example. An airflow 40 flows in an upstream direction within an annulus 42 defined by the liner 34 and the sleeve 38 toward the head end 25 of the combustor assembly 14.

Figure 3:
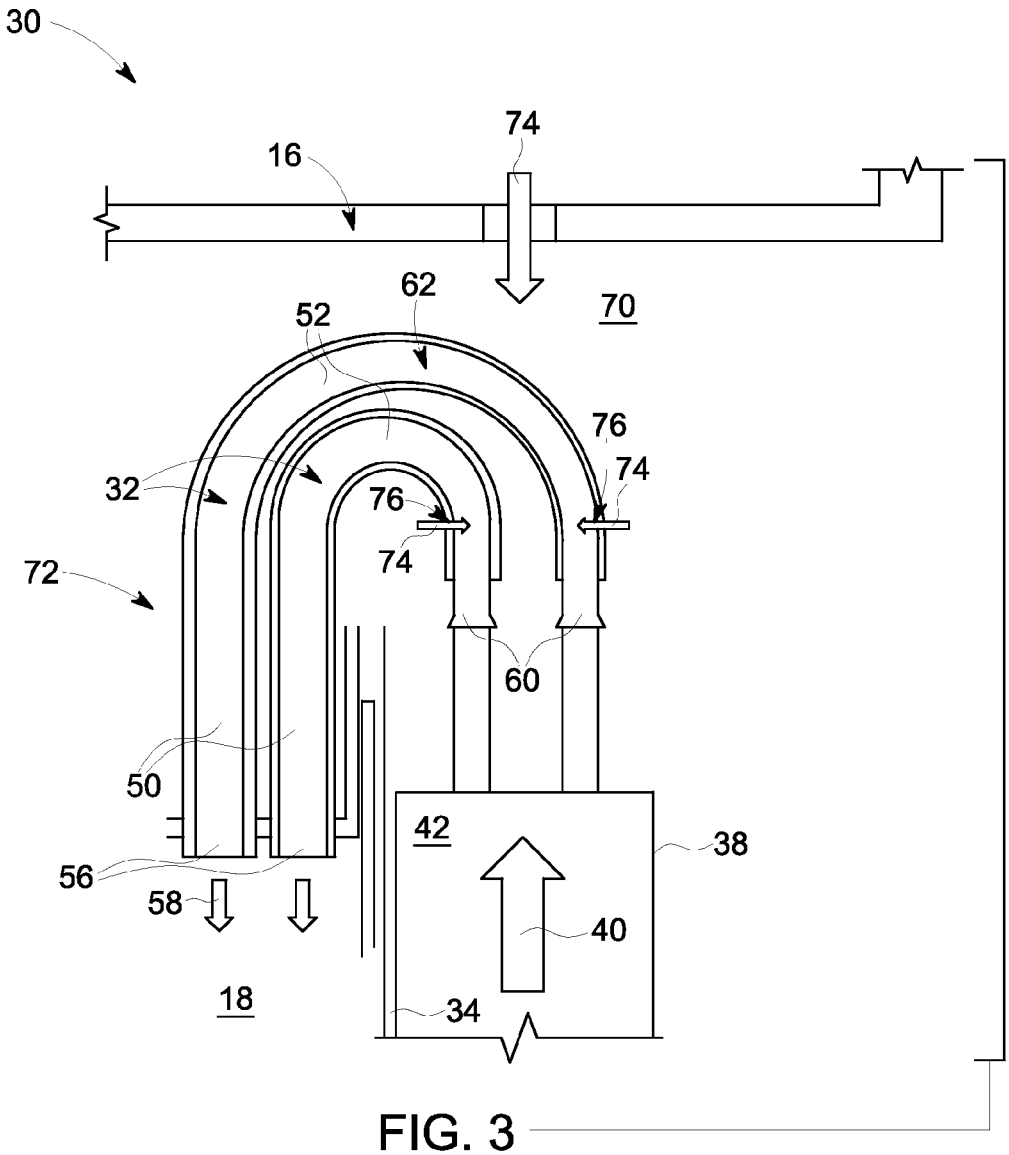
FIG. 3 is a schematic illustration of the micromixer assembly according to a first embodiment.
Figure 8:
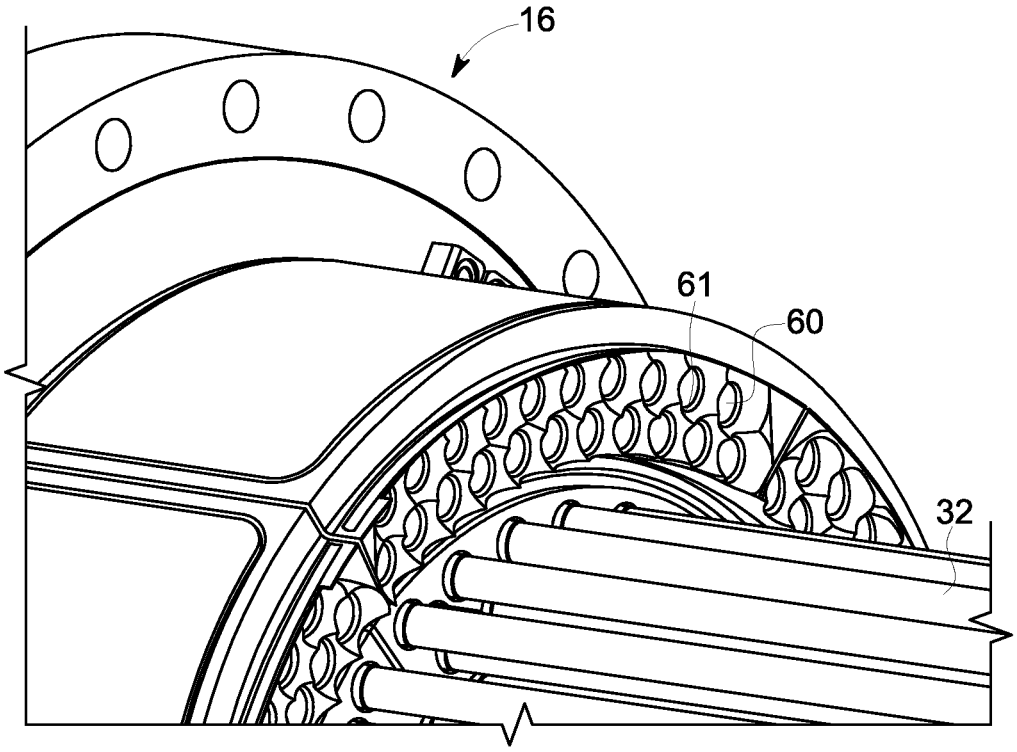
FIG. 8 is a perspective view of an inlet region of the micromixer assembly.

Referring now to FIGS. 3 and 4, in conjunction with FIG. 2, a first embodiment of the micromixer assembly 30 is illustrated. In the illustrated embodiment, each of the plurality of pipes 32 includes a first portion 50 disposed in a relatively linear orientation and extending from a second portion 52 of the plurality of pipes 32 to an outlet 56, where the outlet 56 is formed integrally with, or operably coupled to, a face outlet plate 57. As will be described in detail below, each of the plurality of pipes 32 is configured to route an air-fuel mixture 58 throughout the plurality of pipes to the outlet 56 for distribution to the combustor chamber 18. The second portion 52 of each of the plurality of pipes 32 extends from an inlet 60 disposed in close proximity to the annulus 42 for receiving the airflow 40 therein. The inlet 60 for each of the plurality of pipes 32 may include a "scooped" region 61 (FIG. 8) that facilitates flow uniformity of the airflow 40 upon entry to the plurality of pipes 32. The second portion 52 extends from the inlet 60 to the first portion 50 and includes a curved region 62 that redirects the airflow 40. In the illustrated embodiment, the redirection of the airflow 40 occurs over an angle of about 180 degrees.

A fuel plenum 70 is included and is defined, at least in part, by the endcover assembly 16 and a cap structure 72. The fuel plenum 70 is configured to retain a fuel 74 for delivery to the plurality of pipes 32. More specifically, the fuel 74 is delivered from the fuel plenum 70 to the second portion 52 of the plurality of pipes 32 through at least one fuel receiving path 76. The at least one fuel receiving path 76 may simply be a hole extending through the second portion 52 or may be a more elaborate fuel routing system for introduction of the fuel 74 to the second portion 52. The at least one fuel receiving path 76 may be situated in various locations along or within the plurality of pipes 32. In an exemplary embodiment, the at least one fuel receiving path 76 is disposed at a location of the second portion 52 upstream of the curved region 62, however, it is to be appreciated that the at least one fuel receiving path 76 may be disposed at locations within the curved region 62 or downstream of the curved region 62. Irrespective of the precise configuration and location of the at least one fuel receiving path 76, the fuel 74 is injected into each of the plurality of pipes 32 for mixing with the airflow 40 to form the air-fuel mixture 58 to be distributed to the combustor chamber 18. Routing of the air-fuel mixture 58 through the second portion 52 effectively mixes the airflow 40 and the fuel 74 over a short distance prior to distribution to the combustor chamber 18, which results in beneficial emission performance of the gas turbine engine 10.

Figure 5:
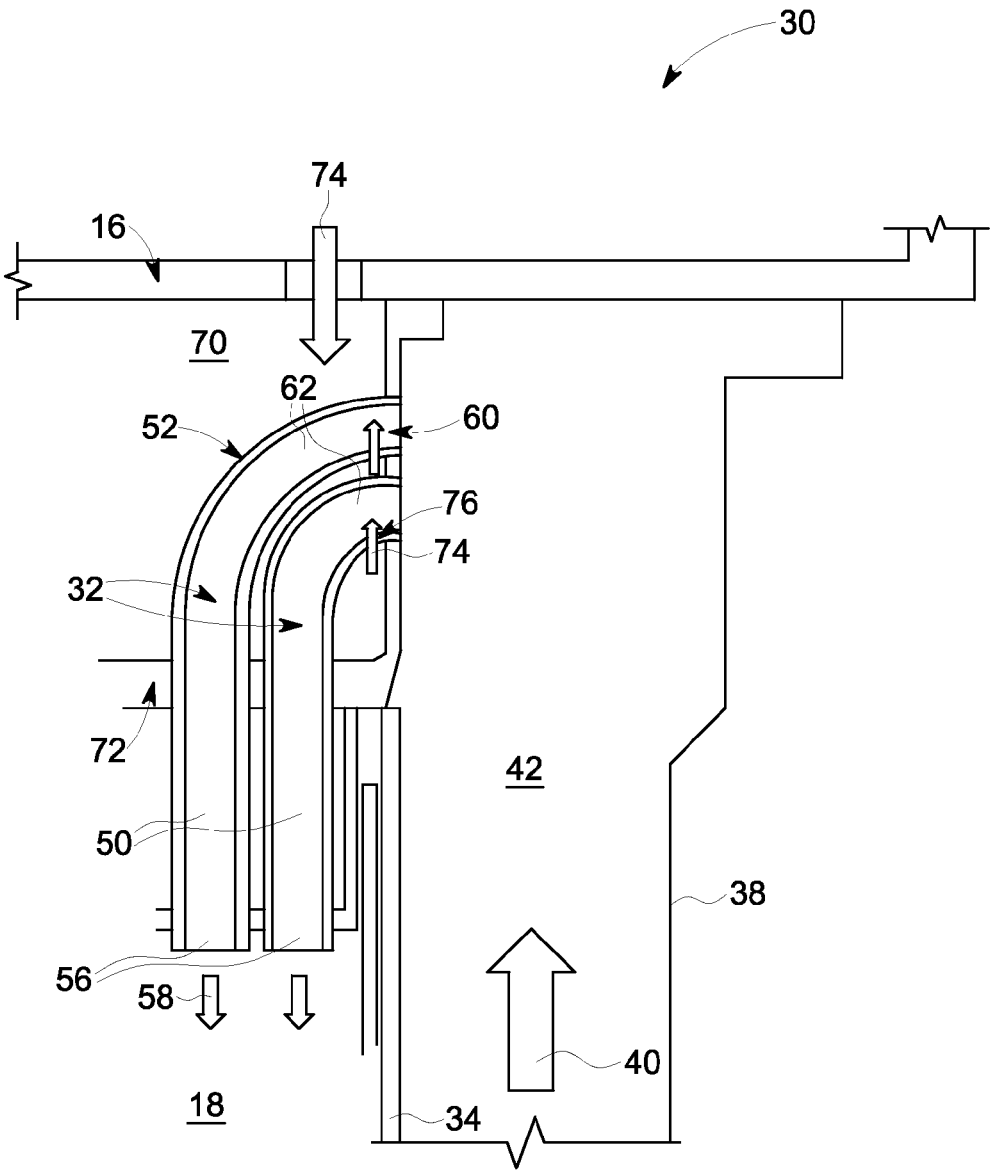
FIG. 5 is a schematic illustration of the micromixer assembly according to a second embodiment.

Referring now to FIG. 5, a second embodiment of the micromixer assembly 30 is illustrated. The second embodiment is similar in many respects to the first embodiment described in detail above, such that duplicative description of each component is not necessary and similar reference numerals are employed where applicable. As shown, the second portion 52 of each of the plurality of pipes 32 route the from the inlet 60 to the first portion 50 over an angle of about 90 degrees, rather than the 180 degrees described above in conjunction with the first embodiment. The inlet 60 is configured to receive the airflow 40 for mixing with the fuel 74 over the curved region 62 of the second portion 52. Although the first embodiment and the second embodiment illustrate and are described as having a 180 degree turn and a 90 degree turn, respectively, it is to be appreciated that the second portion 52 of each of the plurality of pipes 32 may be configured to turn the air-fuel mixture 58 over numerous turning angles. It is contemplated that any turning angle between about 90 degrees and 180 degrees is suitable for effective mixing of the air-fuel mixture 58.

Figure 6:
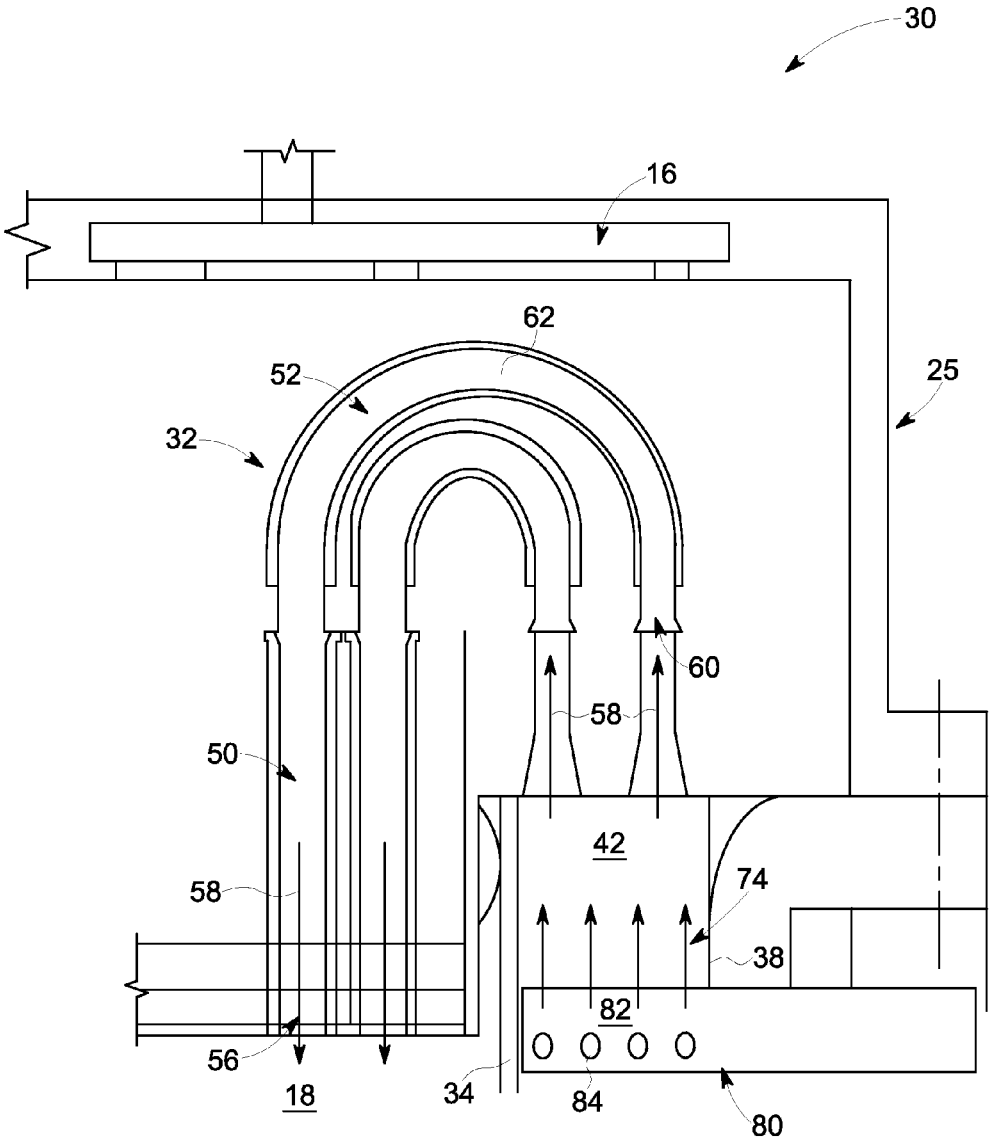
FIG. 6 is a schematic illustration of the micromixer assembly according to a third embodiment.
Figure 7:
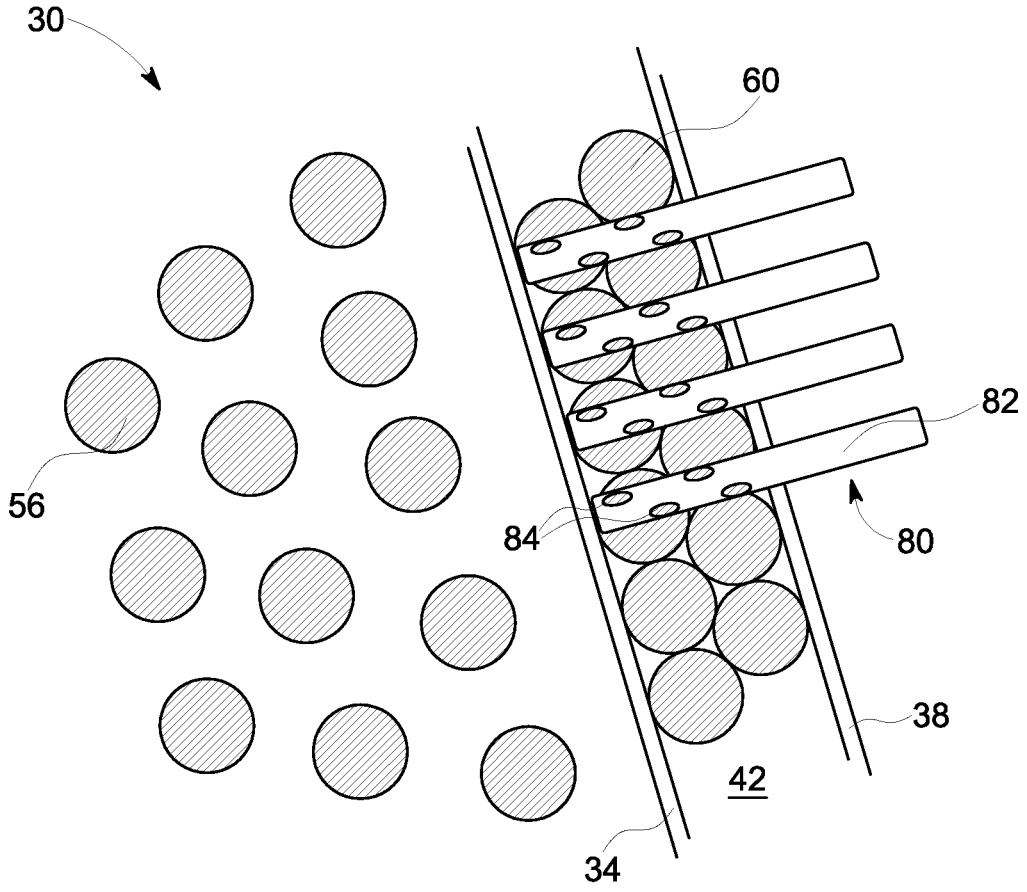
FIG. 7 is a schematic illustration of an end view of the micromixer assembly according to the third embodiment of FIG. 6.

Referring now to FIGS. 6 and 7, a third embodiment of the micromixer assembly 30 is illustrated. The third embodiment is similar in many respects to the first and second embodiments described above, such that duplicative description of each component is not necessary and similar reference numerals are employed where applicable. In the illustrated embodiment, the fuel 74 is distributed into the annulus 42 to form the air-fuel mixture 58 prior to injection of the air-fuel mixture 58 into the inlet 60 of the plurality of pipes 32. Distribution of the fuel 74 into the annulus 42 for mixing with the airflow 40 is achieved by disposal of a fuel injector arrangement 80. The fuel injector arrangement 80 is configured to deliver fuel upstream of the inlet 60 of the plurality of pipes 32. It is to be appreciated that the fuel injector arrangement 80 may be in the form of various geometric configurations. In one embodiment, the fuel injector arrangement 80 comprises at least one airfoil-shaped region 82 having at least one aperture 84 for delivery of the fuel 74 to the annulus 42. The geometry of the at least one airfoil-shaped region 82 is selected based on the aerodynamic properties of an airfoil to reduce the disturbance on the airflow 40 rushing toward the head end 25 through the annulus 42. As noted above, other geometric configurations of the fuel injector arrangement 80 are contemplated. For example, a cylindrical peg may be employed. The exemplary embodiments described above are merely illustrative and numerous suitable shapes may be used to reduce the disturbance on the airflow 40, as described above.

The air-fuel mixture 58 is thereby premixed before entering the inlet 60 of the second portion 52 of the plurality of pipes 32. In the illustrated embodiment, the second portion 52 routes the air-fuel mixture 58 along an angular turn of about 180 degrees to effectively mix the air-fuel mixture 58. As noted above, the second portion 52 may be configured to turn the air-fuel mixture 58 over numerous angles, such as between about 90 degrees and about 180 degrees. Subsequently, the air-fuel mixture 58 is routed through the first portion 50 of the plurality of pipes 32 for distribution into the combustor chamber 18.

The micromixer assembly 30 of any of the above-described embodiments may be fully or partially formed in a number of processes. In an exemplary embodiment, the micromixer assembly 30 is cast to reduce stresses throughout the structure that may be present with various other processes. Alternatively, the micromixer assembly 30 may be fully or partially brazed or formed with an additive process, such as direct metal laser sintering (DMLS), for example. Additionally, a tube expansion process may be employed, wherein the plurality of pipes are expanded into an opening.

Figure 9:
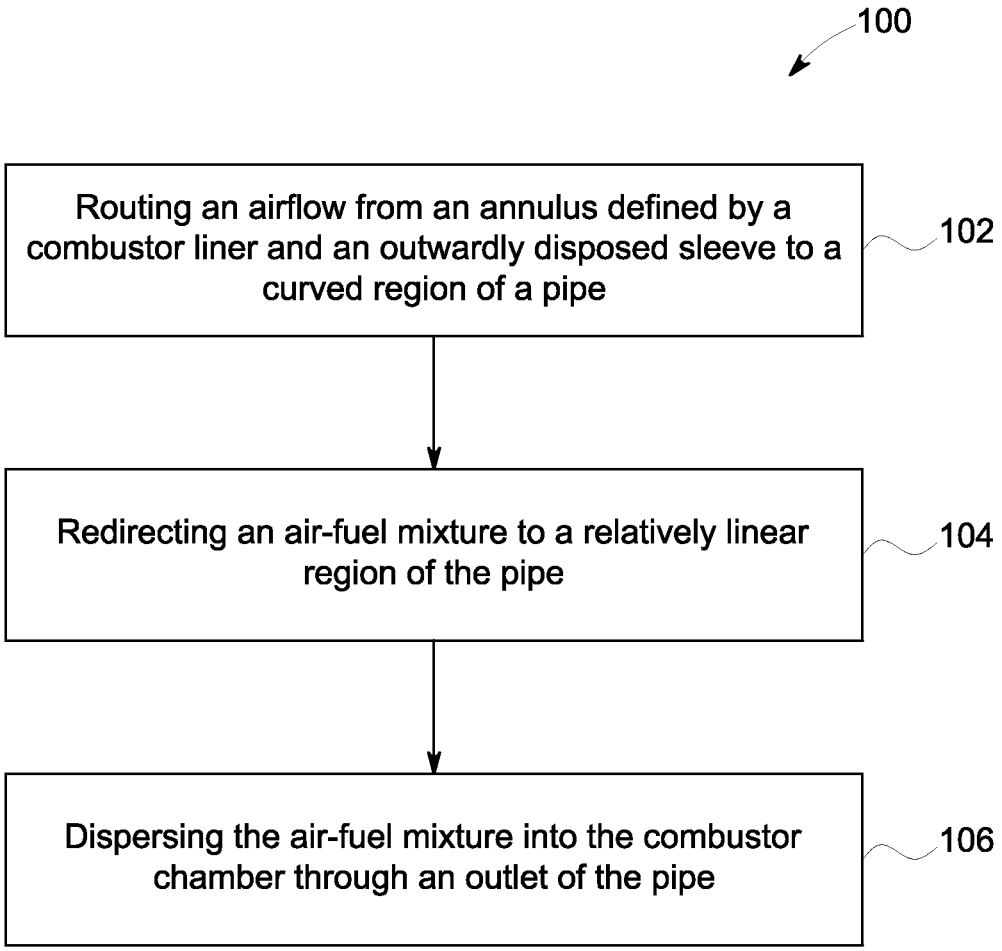
FIG. 9 is a flow diagram illustrating a method of distributing an air-fuel mixture to a combustor chamber of the combustor assembly.

As illustrated in the flow diagram of FIG. 9, and with reference to FIGS. 1-8, a method of distributing an air-fuel mixture to a combustor chamber 100 is also provided. The gas turbine engine 10, as well as the combustor assembly 14 and the micromixer assembly 30 have been previously described and specific structural components need not be described in further detail. The method of distributing an air-fuel mixture to a combustor chamber 100 includes routing an airflow from an annulus defined by an inwardly disposed liner and an outwardly disposed sleeve to a curved region of a pipe 102. The air-fuel mixture is then redirected to a relatively linear region of the pipe 104. The air-fuel mixture is dispersed into the combustor chamber through an outlet of the pipe 106.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A micromixer assembly for a turbine system comprising:

a plurality of pipes, each pipe comprising an inlet section and an outlet section, the inlet section having an inlet in fluid communication with an annulus defined by an inwardly disposed liner and an outwardly disposed sleeve of a combustor, the inlet receiving an air-fuel mixture entering the inlet in a first direction from the annulus, wherein the inlet is directly coupled to the annulus, the outlet section including a straight portion terminating in an outlet for dispersing the air-fuel mixture into a combustor chamber; wherein the inlet section further defines a curved portion between the inlet and the straight portion of the outlet section, the curved portion redirecting the air-fuel mixture from a first flow direction to a second flow direction different from the first flow direction.

2. The micromixer assembly of claim 1, wherein the air-fuel mixture is redirected from the inlet to the outlet at an angle of from 90° to 180°, wherein the angle is defined between a first line drawn parallel to a transverse through the inlet and a second line drawn parallel to a transverse through the outlet.

3. The micromixer assembly of claim 1, further comprising a fuel injector arrangement disposed at least partially in the annulus, the fuel injector arrangement comprising at least one airfoil-shaped region with at least one hole for dispensing fuel.

4. The micromixer assembly of claim 1, wherein at least a portion of the micromixer assembly is formed by a casting process.

5. A micromixer assembly for a turbine system comprising:

a fuel injector arrangement disposed at least partially in an annulus defined between an inwardly disposed liner and an outwardly disposed sleeve of a combustor, the fuel injector arrangement injecting a fuel into the annulus for mixing with an airflow to produce an air-fuel mixture;

a plurality of pipes, each pipe comprising an inlet section and an outlet section, the inlet section having an inlet in fluid communication with the annulus for receiving an air-fuel mixture in a first flow direction from the annulus, wherein the inlet is directly coupled to the annulus, the outlet section having a straight portion terminating in an outlet for dispersing the air-fuel mixture into a combustor chamber; wherein the inlet section further defines curved region between the inlet and the straight portion of the outlet section for redirecting the air-fuel mixture from a first flow direction to a second flow direction different from the first flow direction.

6. The micromixer assembly of claim 5, wherein the fuel injector arrangement comprises at least one airfoil having at least one aperture for injecting the fuel into the airflow flowing throughout the annulus toward an endcover of a combustor assembly.

7. The micromixer assembly of claim 5, wherein the air-fuel mixture is redirected from the inlet to the outlet at an angle of 180°, wherein the angle is defined between a first line drawn parallel to a transverse through the inlet and a second line drawn parallel to a transverse through the outlet.

8. The micromixer assembly of claim 5, wherein at least a portion of the micromixer assembly is formed by a casting process or an additive metal process.

* * * * *